US010600377B2

(12) United States Patent
Zha

(10) Patent No.: US 10,600,377 B2
(45) Date of Patent: Mar. 24, 2020

(54) IMAGE DISPLAY METHOD AND DEVICE OF DETERMINING BACKLIGHT COEFFICIENT ACCORDING TO GRAYSCALE EIGENVALUES CORRESPONDING TO PIXELS IN DIFFERENT PARTITION

(71) Applicant: Wuhan China Star Optoelectronics Technology Co., Ltd., Wuhan, Hubei (CN)

(72) Inventor: Guowei Zha, Guangdong (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 36 days.

(21) Appl. No.: 15/928,539

(22) Filed: Mar. 22, 2018

(65) Prior Publication Data

US 2019/0197971 A1 Jun. 27, 2019

Related U.S. Application Data

(63) Continuation of application No. PCT/CN2018/073081, filed on Jan. 17, 2018.

(30) Foreign Application Priority Data

Dec. 27, 2017 (CN) ..... 2017 1 1446003

(51) Int. Cl.
*G09G 3/36* (2006.01)
*G09G 3/34* (2006.01)

(52) U.S. Cl.
CPC ..... *G09G 3/3607* (2013.01); *G09G 3/3406* (2013.01); *G09G 2320/06* (2013.01); *G09G 2340/16* (2013.01)

(58) Field of Classification Search
CPC ..... G09G 3/36; G11C 19/00; G02F 1/1345; F21V 7/04
See application file for complete search history.

(56) References Cited

U.S. PATENT DOCUMENTS

2006/0152469 A1 7/2006 Hsu
2015/0029237 A1* 1/2015 Chen ..... G09G 3/3413 345/690

(Continued)

FOREIGN PATENT DOCUMENTS

CN 101325038 A 12/2008
CN 101587694 A 11/2009

(Continued)

*Primary Examiner* — Pegeman Karimi
(74) *Attorney, Agent, or Firm* — Hemisphere Law, PLLC; Zhigang Ma

(57) ABSTRACT

An embodiment of the present application discloses an image display method and device. The method includes: determining a first preset parameter of each partition of a backlight relative to a first frame image when a display request for the first frame image is detected, the preset parameter comprising grayscale and/or backlight brightness; acquiring a second preset parameter of each partition of the backlight relative to a second frame image, the second frame image being a previous frame image of the first frame image; determining a grayscale compensation coefficient of a first frame image according to the first preset parameter and the second preset parameter; determining a backlight coefficient of each partition of the first frame image; and driving the backlight according to the determined backlight coefficient of each partition and driving a display screen according to the grayscale compensation coefficient to display the first frame image.

19 Claims, 5 Drawing Sheets

(56) References Cited

U.S. PATENT DOCUMENTS

| | | | | |
|---|---|---|---|---|
| 2015/0365621 | A1* | 12/2015 | Zhang | G09G 5/005 348/791 |
| 2016/0078830 | A1* | 3/2016 | Huang | G09G 3/3406 345/691 |
| 2017/0061897 | A1* | 3/2017 | Zhang | G09G 3/3426 |
| 2017/0061901 | A1* | 3/2017 | Zhang | G09G 3/3426 |
| 2017/0084232 | A1* | 3/2017 | Yang | G09G 3/3426 |

FOREIGN PATENT DOCUMENTS

| | | | |
|---|---|---|---|
| CN | 103117045 | A | 5/2013 |
| CN | 103474042 | A | 12/2013 |
| CN | 105448263 | A | 3/2016 |
| CN | 105719611 | A | 6/2016 |

* cited by examiner

IMAGE DISPLAY METHOD AND DEVICE OF DETERMINING BACKLIGHT COEFFICIENT ACCORDING TO GRAYSCALE EIGENVALUES CORRESPONDING TO PIXELS IN DIFFERENT PARTITION

RELATED APPLICATIONS

This application is a continuation application of PCT Patent Application No. PCT/CN2018/073081, filed Jan. 17, 2018, which claims the priority benefit of Chinese Patent Application No. 201711446003.8, filed Dec. 27, 2017, which is herein incorporated by reference in its entirety.

FIELD OF THE DISCLOSURE

The disclosure relates to a liquid crystal panel displaying technical field, and particularly to an image display method and a device thereof.

BACKGROUND

Into the modern society, the interaction between human and display become an important way for people to access and share information, such display including liquid crystal display due to good screen reproducibility and it has become the mainstream of the display. The basic principle of the liquid crystal display is to irradiate the liquid crystal cell by a backlight, and the liquid crystal cell realizes the size control of the grayscale by light valve through the change of the polarization state of the liquid crystal molecules driven by the TFT array. The display is usually in a state of screen off when it is under an informal working state; however, people gradually come up with the corresponding functions for displaying the time and message in a brief form even under the screen-off state.

SUMMARY

The embodiments of the present application provide an image display method and apparatus, which can reduce the driving power consumption of the display device and keep the overall screen brightness of the display consistent.

According to a first aspect, an embodiment of the present application provides an image display method, including: determining a first preset parameter of each partition of the backlight relative to a first frame image when a display request for the first frame image is detected, the preset parameter comprising grayscale and/or backlight brightness; acquiring a second preset parameter of each partition of the backlight relative to a second frame image, the second frame image being a previous frame image of the first frame image; determining a grayscale compensation coefficient of the first frame image according to the first preset parameter and the second preset parameter; driving the backlight according to the determined backlight coefficient of each partition and driving the display screen according to the grayscale compensation coefficient to display the first frame image.

In a second aspect, embodiments of the present application provides an image display device, including: an acquiring unit, to acquire a second preset parameter of each partition of the backlight relative to a second frame image, the second frame image being a previous frame image of the first frame image; a determining unit, to determine a grayscale compensation coefficient of the first frame image according to the first preset parameter and the second preset parameter; a determining unit, to determine a backlight coefficient of each partition of the first frame image; and a displaying unit, to drive the backlight according to the determined backlight coefficient of each partition and driving the display screen according to the grayscale compensation coefficient to display the first frame image.

According to a third aspect, embodiments of the present application provides an image display device, including a processor, a memory, and one or more programs, the one or more programs being stored in the memory, and the program including: an instruction for executing the steps of any one of the methods of the first aspect of the embodiments of the present application.

According to a fourth aspect, embodiments of the present application provide a computer readable storage medium storing a computer program for electronic data exchange, wherein the computer program causes a computer to execute the method of the first aspect.

In a fifth aspect, embodiments of the present application provide a computer program product, comprising a non-transitory computer-readable storage medium storing a computer program operable to cause a computer to execute the method as set forth in the first aspect described above.

It can be seen that in the embodiments of the present application, the display device firstly determines the first preset parameter of each partition of the backlight relative to the first frame image when detecting the display request for the first frame image; secondly, acquiring a second preset parameter of each partition of the backlight relative to a second frame image, the second frame image being a previous frame image of the first frame image; then, the grayscale compensation coefficient of the first frame image is determined according to the first preset parameter and the second preset parameter; next, the backlight coefficient of each partition of the first frame image is determined; finally, the backlight is driven according to the determined backlight coefficient of each partition, and the display screen is driven according to the grayscale compensation coefficient to display the first frame image. The embodiments of the present application are beneficial to improve the fluency and stability of continuous image display.

BRIEF DESCRIPTION OF THE DRAWINGS

The following briefly introduces the accompanying drawings relative to the embodiments of the present application.

DETAILED DESCRIPTION OF PREFERRED EMBODIMENTS

In order to make those skilled in the art better understand the solutions of the present application, the technical solutions of the embodiments of the present application are clearly and completely described in the following with reference to the accompanying drawings of the embodiments of the present application. Apparently, the described embodiments are merely described as a part of embodiments of the present application, rather than all of the embodiments. All other embodiments obtained by persons of ordinary skill in the art based on the embodiments of the present application without creative efforts shall fall in the protection scope of this application.

The terms "first", "second" and the like in the description and claims of the present application and the drawings are used to distinguish different objects and are not used to describe a specific order. Moreover, the terms "include" and "have" and any variations thereof are intended to cover a non-exclusive inclusion. For example, a process, method, system, product, or device that incorporates a series of steps or units is not limited to the steps or units listed but may optionally further include steps or units not listed or may optionally further include other steps or units inherent to these processes, methods, products, or devices.

Reference herein to "an embodiment" means that a particular feature, structure, or characteristic described in connection with the embodiment may be included in at least one embodiment of the present application. The appearances of the phrase in various places in the specification are not necessarily all referring to the same embodiment, nor are separate or alternative embodiments mutually exclusive of other embodiments. As one of ordinary skill in the art explicitly and implicitly appreciates, the embodiments described herein may be combined with other embodiments.

Hereinafter, some terms of the present application will be explained for understanding by those skilled in the art.

Common display devices include, for example, electronic devices with image display capability, such as a computer display, a television display and a mobile phone display.

The embodiments of the present application are described below with reference to the accompanying drawings.

Figure 1:
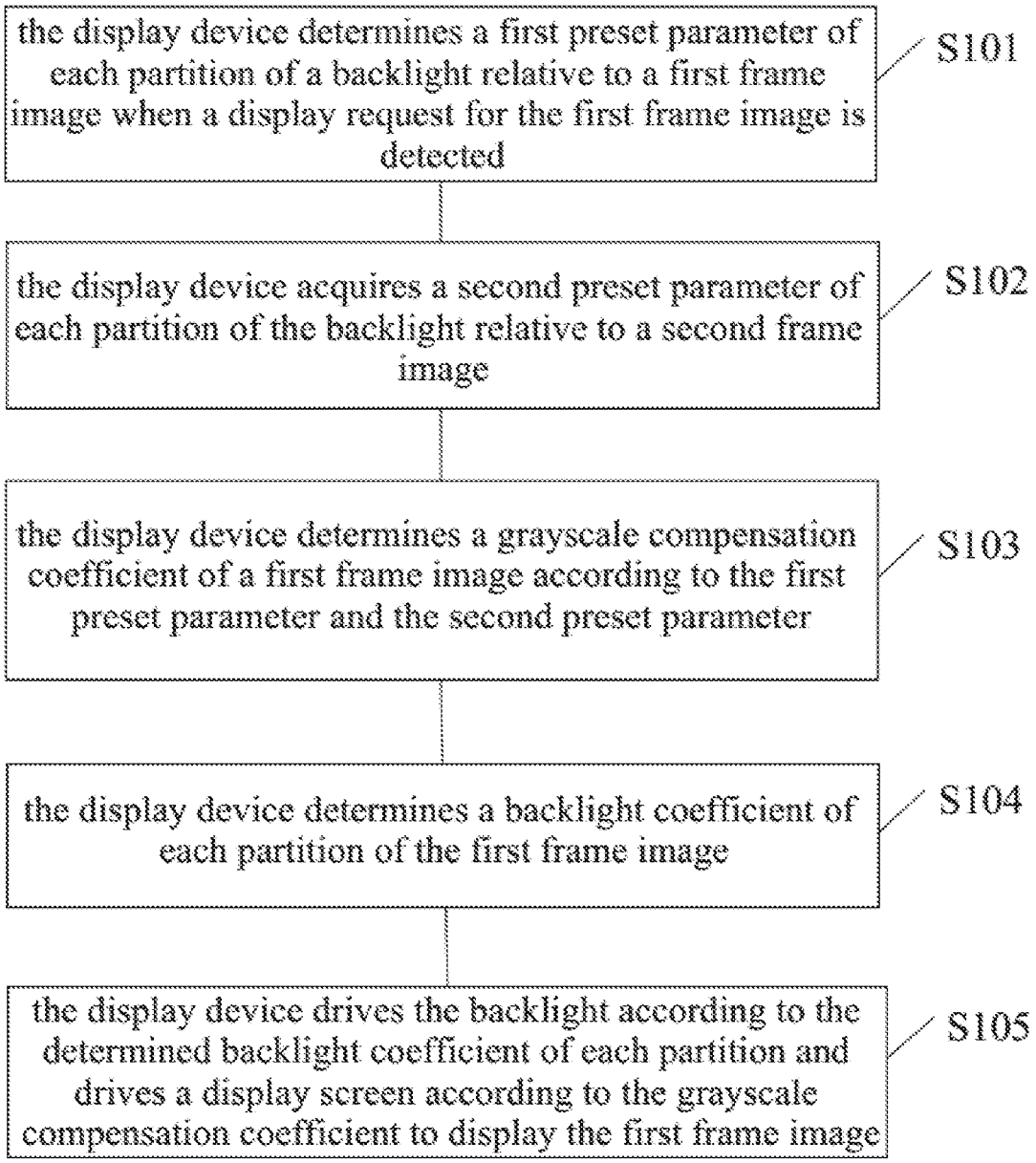
FIG. 1 is a schematic flowchart of an image display method according to an embodiment of the present application.

Referring to FIG. 1, FIG. 1 is a schematic flow chart of an image display method according to an embodiment of the present application, which is applied to a display device. The method includes the following steps.

S101, the display device determines a first preset parameter of each partition of a backlight relative to a first frame image when a display request for the first frame image is detected, the preset parameter comprising grayscale and/or backlight brightness.

Wherein, the display device includes a display screen, which may be a liquid crystal display (LCD), and the backlight as a light source of the display screen, for example, may be a light-emitting diode LED.

Wherein, the partition refers to a physical partition of the backlight, and a physical partitioning policy is not limited, divided into four equal partitions for example.

The first frame image may be a frame image of a video or a collection of photos.

S102, the display device acquires a second preset parameter of each partition of the backlight relative to a second frame image, the second frame image being a previous frame image of the first frame image.

S103, the display device determines a grayscale compensation coefficient of a first frame image according to the first preset parameter and the second preset parameter.

S104, the display device determines a backlight coefficient of each partition of the first frame image.

S105, the display device drives the backlight according to the determined backlight coefficient of each partition and drives a display screen according to the grayscale compensation coefficient to display the first frame image.

It can be seen that in the embodiments of the present application, the display device firstly determines the first preset parameter of each partition of the backlight relative to the first frame image when detecting the display request for the first frame image; secondly, acquiring a second preset parameter of each partition of the backlight relative to a second frame image, the second frame image being a previous frame image of the first frame image; then, the grayscale compensation coefficient of the first frame image is determined according to the first preset parameter and the second preset parameter; next, the backlight coefficient of each partition of the first frame image is determined; finally, the backlight is driven according to the determined backlight coefficient of each partition, and the display screen is driven according to the grayscale compensation coefficient to display the first frame image. The embodiments of the present application are beneficial to improve the fluency and stability of continuous image display. Since the second preset parameter is the historical calculation data of the previous frame image displayed by the display device and the grayscale compensation coefficient of the first frame image, which is to be displayed, is determined according to the first preset parameter and the second preset parameter, the display device can closely associate the current image display process with the previous frame image display process and display the current frame image more accurately and stably, and thereby the fluency and stability of the continuous image display can be improved.

In a possible example, the preset parameter includes a grayscale coefficient, and the "determining a grayscale compensation coefficient of the first frame image according to the first preset parameter and the second preset parameter" includes: acquiring a first grayscale of the first frame image, wherein grayscale includes resolution of the current frame in the height and width directions and three primary light (R/G/B); acquiring a second grayscale of the second frame image; performing a difference operation between the second grayscale and the first grayscale to obtain a difference value; determining the grayscale compensation coefficient of the second frame image is the grayscale compensation coefficient of the first frame image when the difference value is detected to be less than a first default threshold.

Wherein, the grayscale (height, width, 3), height, width are the resolution of the current image in the height and width directions, 3 respectively represents R/G/B, R is the red grayscale eigenvalue, G is the green grayscale eigenvalue, and B is the blue grayscale eigenvalue.

It can be seen that, in this example, since the display device can obtain the image grayscale currently being operated and compare it with the grayscale of the image in the previous frame image, when the grayscales of the two frames are completely the same or the deviation is within the preset threshold error range, it is determined that there is no change signal of the output scene so that the grayscales of the previous frame image are directly output to the grayscale compensation unit so that the repeatedly gray level compensation operation is avoided when the image is still and the backlight is stable and therefore to be in favor of lowering drive power consumption and increasing drive speed.

In a possible example, the preset parameter includes a grayscale coefficient, and the "determining a grayscale compensation coefficient of the first frame image according to the first preset parameter and the second preset parameter" includes: acquiring R/G/B of each pixel in the first frame image; determining a maximum value among R/G/B of each pixel being a grayscale eigenvalue of a corresponding pixel; for each partition in the first frame image, using a maximum value among all the grayscale eigenvalues in the partition as a backlight coefficient reference value of the partition, and the acquired backlight coefficient reference value is a first reference backlight coefficient backlight coefficient; determining the first reference backlight coefficient of each partition of the first frame image according to the grayscale eigenvalue of each pixel; acquiring a second backlight coefficient of each partition in the second frame image; calculating a root mean square difference value between the first reference backlight coefficient and the second backlight coefficient corresponding to all the partitions; and determining the grayscale compensation coefficient of the second frame image is the grayscale compensation coefficient of the first frame image if the root mean square difference value is less than or equal to the second preset threshold.

For example, img.getPixel(x, y) returns a pixel with pixel information of ARGB.32 and up to 8 bits of transparency information. Assuming that there are three pixels in the current frame image, R/G/B corresponding to A pixel is (2,3,4), R/G/B of B pixel is (2,4,3), R/G/B of C pixel is (3,4,5), then (3,4,5) is the grayscale eigenvalue; that is, in the current 36*36 area, (3,4,5) is the backlight coefficient reference value of the current frame. In the previous frame, the compensation grayscale is j (such as 225) and the second backlight coefficient is (5,4,6); when the difference is in the range of 0-10, it is determined the backlight coefficient ins unchanged; and when (3, 4, 5) and (5, 4, 6) are targeted to the root mean square value operation, and the difference is $\sqrt{3}$, which is within the preset range, then the compensation grayscale j (for example, 225) in the previous frame is determined as the compensated grayscale of the current frame, that is, the compensated grayscale is j (for example, 225) and is output to the Source IC for driving.

It can be seen that, in this example, since the display device can determine the grayscale eigenvalues of the pixel according to the R/G/B of the pixel in the current image and thereby obtain the backlight coefficient reference value of the partition and compare it with the backlight coefficient of the previous frame image, the two frames having exactly the same results after the root mean square operation or having deviations within the preset threshold error range, it is determined that there is no change signal of the output scene so that the grayscales of the previous frame image are directly output to the grayscale compensation unit so that the repeatedly gray level compensation operation is avoided when the image is still and the backlight is stable and therefore to be in favor of lowering drive power consumption and increasing drive speed.

In a possible example, the preset parameter includes a grayscale coefficient and a backlight coefficient, and the "determining a grayscale compensation coefficient of the first frame image according to the first preset parameter and the second preset parameter" includes: acquiring a first grayscale of the first frame image, wherein grayscale includes resolution of the current frame in the height and width directions and three primary light (R/G/B); acquiring a second grayscale of the second frame image; performing a difference operation between the second grayscale and the first grayscale to obtain a difference value; acquiring R/G/B of each pixel in the first frame image; determining a maximum value among R/G/B of each pixel being a grayscale eigenvalue of a corresponding pixel; for each partition in the first frame image, using a maximum value among all the grayscale eigenvalues in the partition as a backlight coefficient reference value of the partition, and the acquired backlight coefficient reference value is a first reference backlight coefficient backlight coefficient; determining the first reference backlight coefficient of each partition of the first frame image according to the grayscale eigenvalue of each pixel; acquiring a second backlight coefficient of each partition in the second frame image; calculating a root mean square difference value between the first reference backlight coefficients and second backlight coefficients to all partitions; and determining the grayscale compensation coefficient of the second frame image is the grayscale compensation coefficient of the first frame image if the root mean square difference value is less than or equal to the second preset threshold.

It can be seen that, in this example, since the display device can obtain the image grayscale currently being operated and compare it with the grayscale of the image in the previous frame image, when the grayscales of the two frames are completely the same or the deviation is within the preset threshold error range, it is determined that there is no change signal of the output scene is the first condition; and the grayscale eigenvalues of the pixel is determined by R/G/B of the pixel in the current image, and thereby obtain the backlight coefficient reference value of the partition and compare it with the backlight coefficient of the previous frame image, the two frames having exactly the same results after the root mean square operation or having deviations within the preset threshold error range, it is determined that there is no change signal of the output scene is the second condition. Only when the first condition and the second condition are satisfied at the same time, the grayscale compensation operation is performed, and thus the repeatedly gray level compensation operation is avoided in a single situation and therefore it is in favor of lowering drive power consumption and increasing drive speed.

In a possible example, the "determining the first reference backlight coefficient of each partition of the first frame image according to the grayscale eigenvalue of each pixel" includes: determining a plurality of pixels included in each partition of the first frame image; and determining a maximum grayscale eigenvalue among a plurality of grayscale eigenvalue corresponding to the plurality of pixels is the first reference backlight coefficient of the corresponding partition.

It can be seen that, in this example, since the display device determines the backlight coefficient according to the grayscale eigenvalues corresponding to the plurality of pixels of each partition, the backlight coefficient can be adjusted in real time by the change of pixel points, so that repeatedly gray level compensation operation by the display device is avoided, and therefore it is in favor of the accuracy and timeliness of the display device to adjust the backlight brightness.

In a possible example, the "determining a backlight coefficient of each partition of the first frame image" includes: performing a difference operation between a first backlight coefficient reference value of each partition of the first frame image and a second backlight coefficient of each partition of the second frame image to obtain a difference value; if the difference value is greater than a third preset threshold is detected, adding or subtracting a first preset adjustment value from the second backlight coefficient to obtain a first backlight coefficient of each partition; or if the difference value is less than or equal to the third preset threshold, adding or subtracting a second preset adjustment value from the second backlight coefficient to obtain a first backlight coefficient of each partition; and the first preset adjustment value being greater than the second preset adjustment value.

It can be seen that, in this example, since the display device adjusts the current scene according to the preset adjustment value and the scene changes results in the backlight coefficient changes largely, a larger first preset adjustment value is used to adjust the changed backlight coefficient to match the rapid change of the scene; and when the scene continuously changes slowly, the backlight coefficient changes with a smaller second preset adjustment value to avoid the flickering phenomenon, which is favorable for the display device to perform rapid backlight brightness adjustment.

In a possible example, the "driving the backlight according to the determined backlight coefficient of each partition and driving a display screen according to the grayscale compensation coefficient to display the first frame image" includes: inputting a first backlight coefficient into a backlight driver chip to instruct the backlight driver chip to drive the backlight; and inputting a grayscale compensation coefficient into an image driver chip to instruct the image driver chip to display the first frame image.

It can be seen that, in this example, since the display device not only needs the grayscale compensation coefficient when driving the backlight, but also needs the actual backlight coefficient of each partition, the brightness of the display image displayed in the display screen can be effectively adjusted by the two coefficients, and the backlight drive and the display drive can have better control on image driving, which is favorable for the display device to lower power consumption and increase drive speed.

Figure 2:
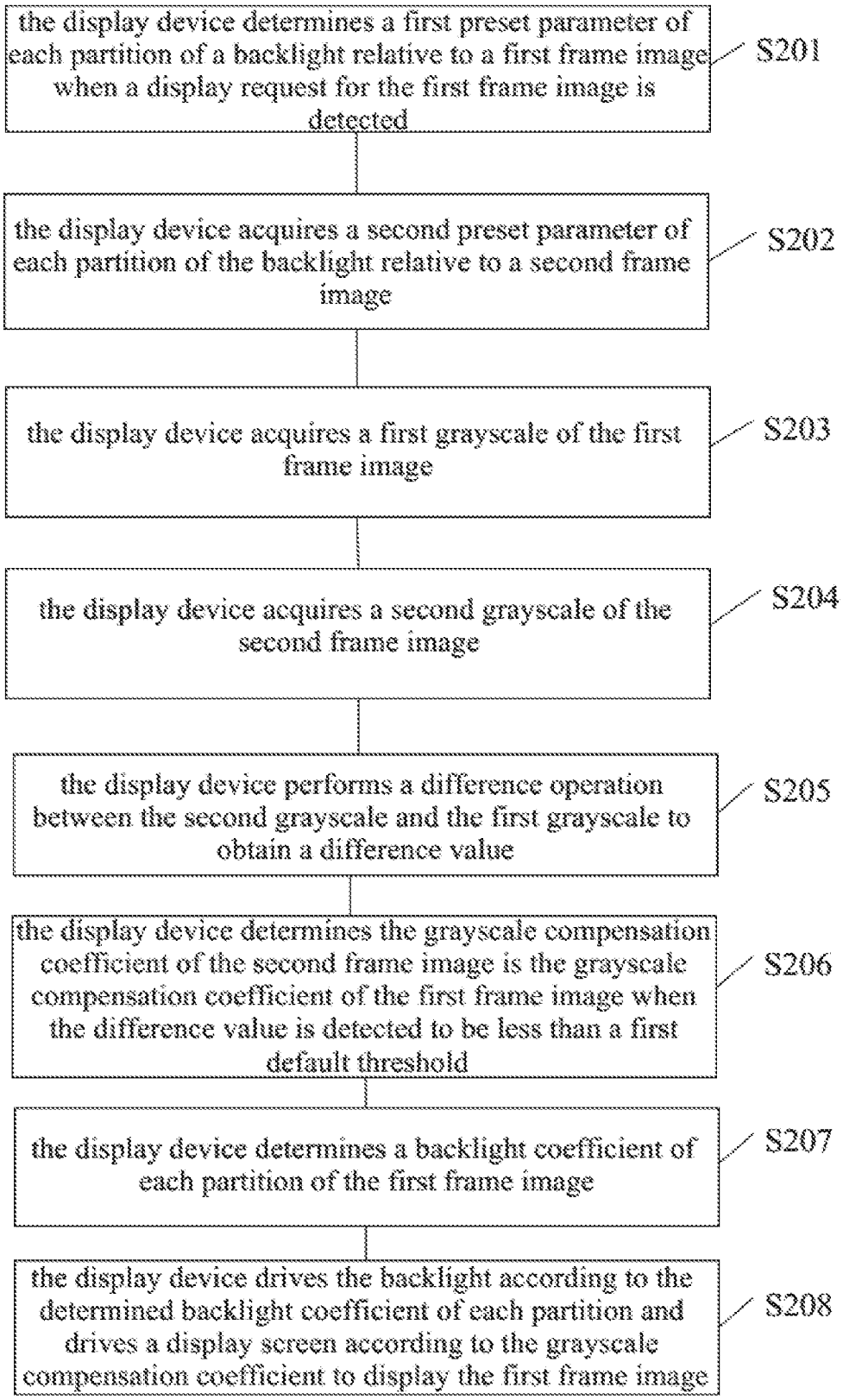
FIG. 2 is a schematic flowchart of an image display method according to an embodiment of the present application.

Referring to FIG. 2, which is consistent with the embodiment shown in FIG. 1, FIG. 2 is schematic flowcharts of an image display method according to an embodiment of the present application, which is applied to a display device. The method includes the following.

S201, the display device determines a first preset parameter of each partition of a backlight relative to a first frame image when a display request for the first frame image is detected.

S202, the display device acquires a second preset parameter of each partition of the backlight relative to a second frame image, the second frame image being a previous frame image of the first frame image.

S203, the display device acquires a first grayscale of the first frame image, wherein grayscale includes resolution of the current frame in the height and width directions and three primary light (R/G/B).

S204, the display device acquires a second grayscale of the second frame image.

S205, the display device performs a difference operation between the second grayscale and the first grayscale to obtain a difference value.

S206, the display device determines the grayscale compensation coefficient of the second frame image is the grayscale compensation coefficient of the first frame image when the difference value is detected to be less than a first default threshold.

S207, the display device determines a backlight coefficient of each partition of the first frame image.

S208, the display device drives the backlight according to the determined backlight coefficient of each partition and drives a display screen according to the grayscale compensation coefficient to display the first frame image.

It can be seen that in the embodiments of the present application, the display device firstly determines the first preset parameter of each partition of the backlight relative to the first frame image when detecting the display request for the first frame image; secondly, acquiring a second preset parameter of each partition of the backlight relative to a second frame image, the second frame image being a previous frame image of the first frame image; then, the grayscale compensation coefficient of the first frame image is determined according to the first preset parameter and the second preset parameter, next, the backlight coefficient of each partition of the first frame image is determined; finally, the backlight is driven according to the determined backlight coefficient of each partition, and the display screen is driven according to the grayscale compensation coefficient to display the first frame image. The embodiments of the present application are beneficial to improve the fluency and stability of continuous image display. Since the second preset parameter is the historical calculation data of the previous frame image displayed by the display device and the grayscale compensation coefficient of the first frame image, which is to be displayed, is determined according to the first preset parameter and the second preset parameter, the display device can closely associate the current image display process with the previous frame image display process and display the current frame image more accurately and stably, and thereby the fluency and stability of the continuous image display can be improved.

In addition, the repeatedly gray level compensation operation is avoided when the image is still and the backlight is stable and therefore to be in favor of lowering drive power consumption and increasing drive speed.

Figure 3:
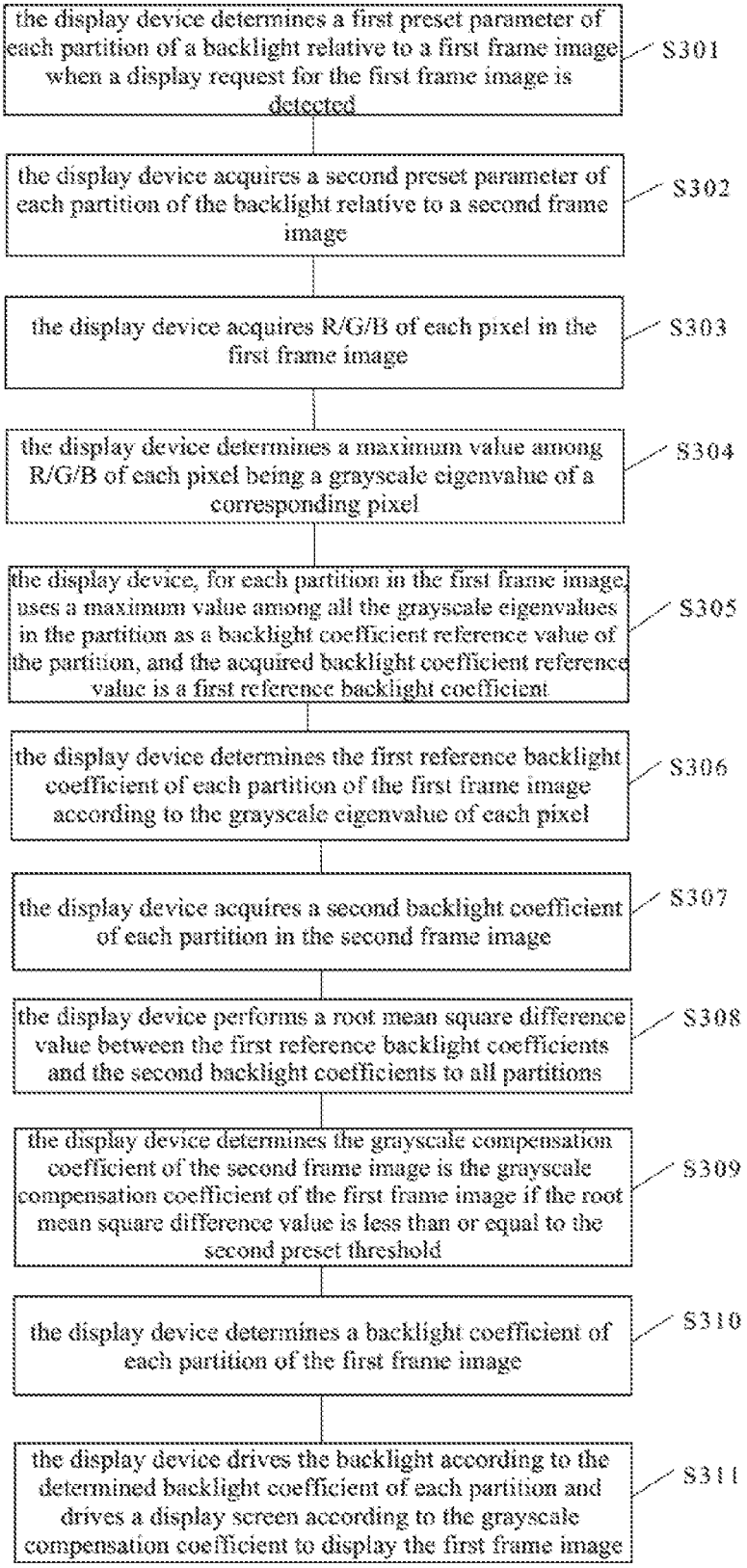
FIG. 3 is a schematic flowchart of an image display method according to an embodiment of the present application.

Referring to FIG. 3, which is consistent with the embodiment shown in FIG. 1, FIG. 3 is schematic flowcharts of an image display method according to an embodiment of the present application, which is applied to a display device. The method includes the following.

S301, the display device determines a first preset parameter of each partition of a backlight relative to a first frame image when a display request for the first frame image is detected.

S302, the display device acquires a second preset parameter of each partition of the backlight relative to a second frame image, the second frame image being a previous frame image of the first frame image.

S303, the display device acquires RIG/B of each pixel in the first frame image.

S304, the display device determines a maximum value among R/G/B of each pixel being a grayscale eigenvalue of a corresponding pixel.

S305, the display device, for each partition in the first frame image, uses a maximum value among all the grayscale eigenvalues in the partition as a backlight coefficient reference value of the partition, and the acquired backlight coefficient reference value is a first reference backlight coefficient.

S306, the display device determines the first reference backlight coefficient of each partition of the first frame image according to the grayscale eigenvalue of each pixel.

S307, the display device acquires a second backlight coefficient of each partition in the second frame image.

S308, the display device performs a root mean square difference value between the first reference backlight coefficients and the second backlight coefficients to all partitions.

S309, the display device determines the grayscale compensation coefficient of the second frame image is the grayscale compensation coefficient of the first frame image if the root mean square difference value is less than or equal to the second preset threshold.

S310, the display device determines a backlight coefficient of each partition of the first frame image.

S311, the display device drives the backlight according to the determined backlight coefficient of each partition and drives a display screen according to the grayscale compensation coefficient to display the first frame image.

It can be seen that in the embodiments of the present application, the display device firstly determines the first preset parameter of each partition of the backlight relative to the first frame image when detecting the display request for the first frame image; secondly, acquiring a second preset parameter of each partition of the backlight relative to a second frame image, the second frame image being a previous frame image of the first frame image; then, the grayscale compensation coefficient of the first frame image is determined according to the first preset parameter and the second preset parameter; next, the backlight coefficient of each partition of the first frame image is determined; finally, the backlight is driven according to the determined backlight coefficient of each partition, and the display screen is driven according to the grayscale compensation coefficient to display the first frame image. The embodiments of the present application are beneficial to improve the fluency and stability of continuous image display. Since the second preset parameter is the historical calculation data of the previous frame image displayed by the display device and the grayscale compensation coefficient of the first frame image, which is to be displayed, is determined according to the first preset parameter and the second preset parameter, the display device can closely associate the current image display process with the previous frame image display process and display the current frame image more accurately and stably, and thereby the fluency and stability of the continuous image display can be improved.

In addition, the repeatedly gray level compensation operation is avoided when the image is still and the backlight is stable and therefore to be in favor of lowering drive power consumption and increasing drive speed.

Figure 4:
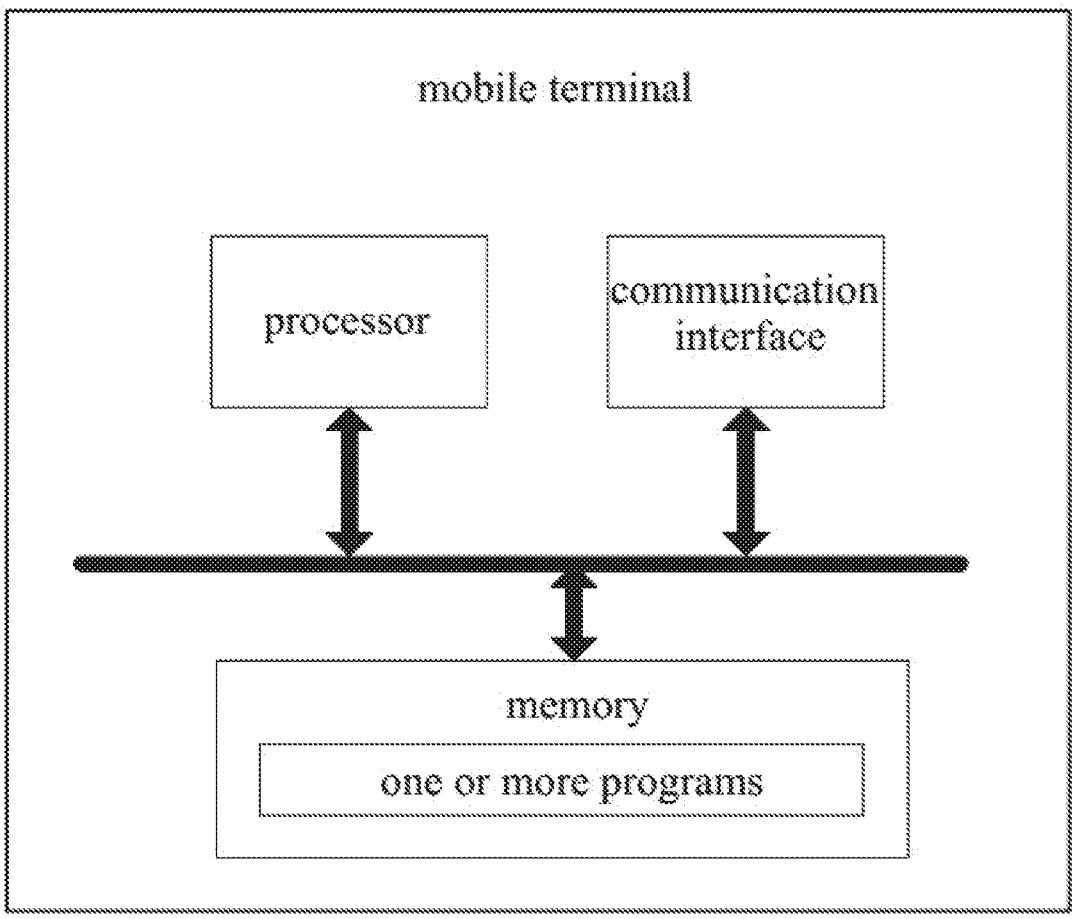
FIG. 4 is a schematic structural diagram of an image display device according to an embodiment of the present application.

Referring to FIG. 4, which is consistent with the embodiments shown in FIG. 1 to FIG. 3, is a schematic structural diagram of an image display device according to an embodiment of the present application. The image display device includes a processor, a memory, and one or more programs; wherein the one or more programs are stored in the memory, and the program includes an instruction for executing the following steps: determining a first preset parameter of each partition of a backlight relative to a first frame image when a display request for the first frame image is detected, the preset parameter comprising grayscale and/or backlight brightness; acquiring a second preset parameter of each partition of the backlight relative to a second frame image, the second frame image being a previous frame image of the first frame image; determining a grayscale compensation coefficient of a first frame image according to the first preset parameter and the second preset parameter; determining a backlight coefficient of each partition of the first frame image; and driving the backlight according to the determined backlight coefficient of each partition and driving the display screen according to the grayscale compensation coefficient to display the first frame image.

It can be seen that in the embodiments of the present application, the display device firstly determines the first preset parameter of each partition of the backlight relative to the first frame image when detecting the display request for the first frame image; secondly, acquiring a second preset parameter of each partition of the backlight relative to a second frame image, the second frame image being a previous frame image of the first frame image; then, the grayscale compensation coefficient of the first frame image is determined according to the first preset parameter and the second preset parameter; next, the backlight coefficient of each partition of the first frame image is determined; finally, the backlight is driven according to the determined backlight coefficient of each partition, and the display screen is driven according to the grayscale compensation coefficient to display the first frame image. The embodiments of the present application are beneficial to improve the fluency and stability of continuous image display. Since the second preset parameter is the historical calculation data of the previous frame image displayed by the display device and the grayscale compensation coefficient of the first frame image, which is to be displayed, is determined according to the first preset parameter and the second preset parameter, the display device can closely associate the current image display process with the previous frame image display process and display the current frame image more accurately and stably, and thereby the fluency and stability of the continuous image display can be improved.

In a possible example, in the aspect of "determining a grayscale compensation coefficient of a first frame image according to the first preset parameter and the second preset parameter", the instruction in the program are specifically configured to perform the following operations: acquiring a first grayscale of the first frame image, wherein grayscale includes resolution of the current frame in the height and width directions and three primary light (R/G/B); acquiring a second grayscale of the second frame image; performing a difference operation between the second grayscale and the first grayscale to obtain a difference value; and determining the grayscale compensation coefficient of the second frame image is the grayscale compensation coefficient of the first frame image when the difference value is detected to be less than a first default threshold.

In a possible example, in the aspect of "determining a grayscale compensation coefficient of a first frame image according to the first preset parameter and the second preset parameter", the instruction in the program are specifically configured to perform the following operations: acquiring R/G/B of each pixel in the first frame image; determining a maximum value among R/G/B of each pixel being a grayscale eigenvalue of a corresponding pixel; for each partition in the first frame image, using a maximum value among all the grayscale eigenvalues in the partition as a backlight coefficient reference value of the partition, and the acquired backlight coefficient reference value is a first reference backlight coefficient; determining the first reference backlight coefficient of each partition of the first frame image according to the grayscale eigenvalue of each pixel; acquiring a second backlight coefficient of each partition in the second frame image; and determining the grayscale compensation coefficient of the second frame image is the grayscale compensation coefficient of the first frame image if the root mean square difference value is less than or equal to the second preset threshold.

In a possible example, in the aspect of the "determining a grayscale compensation coefficient of the first frame image according to the first preset parameter and the second preset parameter", the instruction in the program are specifically configured to perform the following operations: acquiring a first grayscale of the first frame image, wherein grayscale includes resolution of the current frame in the height and width directions and three primary light (R/G/B); acquiring a second grayscale of the second frame image; performing a difference operation between the second grayscale and the first grayscale to obtain a difference value; acquiring R/G/B of each pixel in the first frame image; determining a maximum value among R/G/B of each pixel being a grayscale eigenvalue of a corresponding pixel; for each partition in the first frame image, using a maximum value among all the grayscale eigenvalues in the partition as a backlight coefficient reference value of the partition, and the acquired backlight coefficient reference value is a first reference backlight coefficient; determining the first reference backlight coefficient of each partition of the first frame image according to the grayscale eigenvalue of each pixel; acquiring a second backlight coefficient of each partition in the second frame image; calculating a root mean square difference value between the first reference backlight coefficients and second backlight coefficients to all partitions; determining the grayscale compensation coefficient of the second frame image is the grayscale compensation coefficient of the first frame image if the root mean square difference value is less than a first preset threshold and the root mean square difference value less than or equal to a second default threshold.

In a possible example, in the aspect of the "determining the first reference backlight coefficient of each partition of the first frame image according to the grayscale eigenvalue of each pixel", the instruction in the program are specifically configured to perform the following operations: determining a plurality of pixels included in each partition of the first frame image; and for each partition in the first frame image, using a maximum value among all the grayscale eigenvalues in the partition as a backlight coefficient reference value of the partition, and the acquired backlight coefficient reference value is a first reference backlight coefficient.

In a possible example, in the aspect of the "determining a backlight coefficient of each partition of the first frame image", the instruction in the program are specifically configured to perform the following operations: performing a difference operation between a first backlight coefficient reference value of each partition of the first frame image and a second backlight coefficient of each partition of the second frame image to obtain a difference value; if the difference value is greater than a third preset threshold is detected, adding or subtracting a first preset adjustment value from the second backlight coefficient to obtain a first backlight coefficient of each partition; or, if the difference value is less than or equal to the third preset threshold, adding or subtracting a second preset adjustment value from the second backlight coefficient to obtain a first backlight coefficient of each partition; and the first preset adjustment value being greater than the second preset adjustment value.

In a possible example, in the aspect of the "driving the backlight according to the determined backlight coefficient of each partition and driving the display screen according to the grayscale compensation coefficient to display the first frame image", the instruction in the program are specifically configured to perform the following operations: inputting a first backlight coefficient into a backlight driver chip to instruct the backlight driver chip to drive the backlight; and inputting a grayscale compensation coefficient into an image driver chip to instruct the image driver chip to display the first frame image.

The foregoing solution of the embodiments of the present application is mainly described from the perspective of the execution process of a method-side of view. It is understood that, in order to achieve the above-mentioned functions, the display driving device includes hardware structures and/or software modules corresponding to the respective functions. Those skilled in the art should readily recognize that, in combination with the example units and algorithm steps described in the embodiments disclosed herein, the present application can be implemented in hardware or a combination of hardware and computer software. Whether a function is implemented by way of hardware or computer software-driven hardware depends on the particular application and design constraints of the technical solution. A person skilled in the art may use different methods to implement the described functions for each particular application, but such implementation should not be considered as beyond the scope of the present application.

The embodiment of the present application may divide functional units of the comment processing apparatus according to the foregoing method examples. For example, each functional unit may be divided corresponding to each function, or two or more functions may be integrated into one processing unit. The above-mentioned integrated unit can be implemented in the form of hardware or in the form of software functional unit. It should be noted that the division of units in the embodiments of the present application is schematic, and is merely a logical function division, and there may be other division manners in actual implementation.

Figure 5:
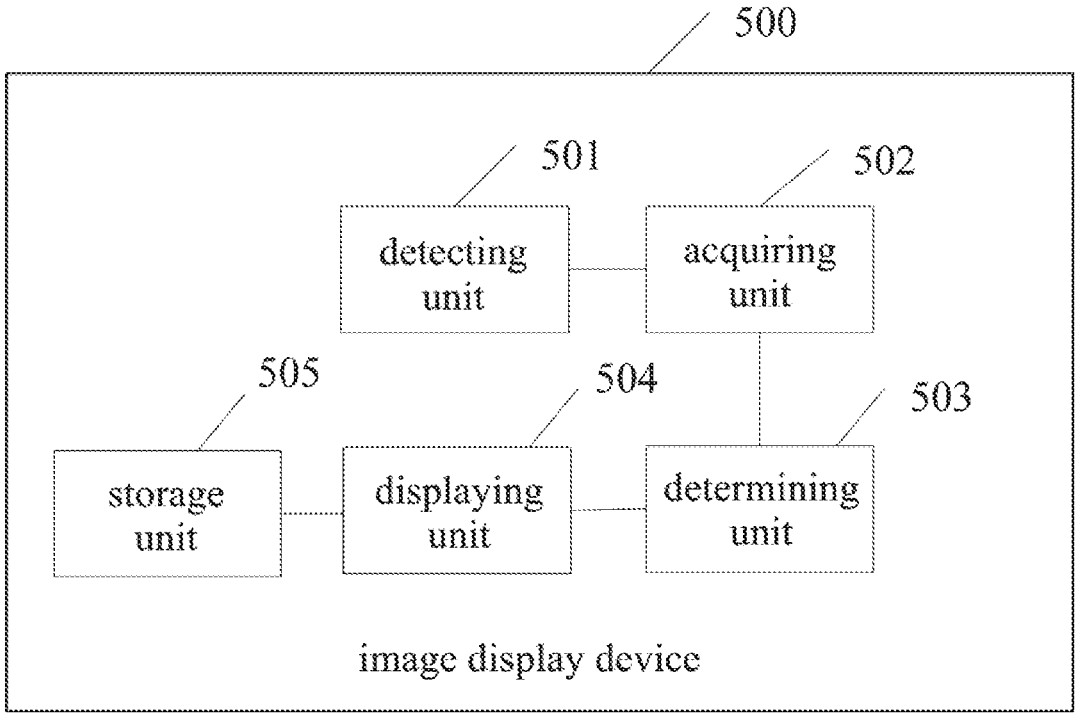
FIG. 5 is a schematic structural diagram of another image display device according to an embodiment of the present application.

FIG. 5 shows a block diagram of possible functional units of the image display device according to the above embodiment. The image display device 500 includes: a detecting unit 501, an acquiring unit 502, a determining unit 503, and a displaying unit 504. The image display device may further include a storage unit 505 for storing the program codes and the data. Wherein, the detecting unit 501 is for determining a first preset parameter of each partition of a backlight relative to a first frame image when a display request for the first frame image is detected, the preset parameter comprising grayscale and/or backlight brightness; the acquiring unit 502 is for acquiring a second preset parameter of each partition of the backlight relative to a second frame image, the second frame image being a previous frame image of the first frame image; the determining unit 503 is for determining a grayscale compensation coefficient of a first frame image according to the first preset parameter and the second preset parameter; the determining unit 503 is for determining a backlight coefficient of each partition of the first frame image; and the displaying unit 504 is for driving the backlight according to the determined backlight coefficient of each partition and driving the display screen according to the grayscale compensation coefficient to display the first frame image.

It can be seen that in the embodiments of the present application, the display device firstly determines the first preset parameter of each partition of the backlight relative to the first frame image when detecting the display request for the first frame image; secondly, acquiring a second preset parameter of each partition of the backlight relative to a second frame image, the second frame image being a previous frame image of the first frame image; then, the grayscale compensation coefficient of the first frame image is determined according to the first preset parameter and the second preset parameter; next, the backlight coefficient of each partition of the first frame image is determined; finally, the backlight is driven according to the determined backlight coefficient of each partition, and the display screen is driven according to the grayscale compensation coefficient to display the first frame image. The embodiments of the present application are beneficial to improve the fluency and stability of continuous image display. Since the second preset parameter is the historical calculation data of the previous frame image displayed by the display device and the grayscale compensation coefficient of the first frame image, which is to be displayed, is determined according to the first preset parameter and the second preset parameter, the display device can closely associate the current image display process with the previous frame image display process and display the current frame image more accurately and stably, and thereby the fluency and stability of the continuous image display can be improved.

In a possible example, in the aspect of the "determining a grayscale compensation coefficient of a first frame image according to the first preset parameter and the second preset parameter", the determining unit 503 is specifically for acquiring a first grayscale of the first frame image, wherein grayscale includes resolution of the current frame in the height and width directions and three primary light (R/G/B); and controlling acquiring a second grayscale of the second frame image; and controlling performing a difference operation between the second grayscale and the first grayscale to obtain a difference value; and controlling determining the grayscale compensation coefficient of the second frame image is the grayscale compensation coefficient of the first frame image when the difference value is detected to be less than a first default threshold.

In a possible example, in the aspect of the "determining a grayscale compensation coefficient of a first frame image according to the first preset parameter and the second preset parameter", the determining unit 503 is specifically for acquiring R/G/B of each pixel in the first frame image; and controlling determining a maximum value among R/G/B of each pixel being a grayscale eigenvalue of a corresponding pixel; and controlling for each partition in the first frame image, using a maximum value among all the grayscale eigenvalues in the partition as a backlight coefficient reference value of the partition, and the acquired backlight coefficient reference value is a first reference backlight coefficient; and controlling determining the first reference backlight coefficient of each partition of the first frame image according to the grayscale eigenvalue of each pixel; and controlling acquiring a second backlight coefficient of each partition in the second frame image; and controlling determining the grayscale compensation coefficient of the second frame image is the grayscale compensation coefficient of the first frame image if the root mean square difference value is less than a first preset threshold and the root mean square difference value less than or equal to a second default threshold.

In a possible example, in the aspect of the preset parameter includes a grayscale coefficient and a backlight coefficient, the determining a grayscale compensation coefficient of the first frame image according to the first preset parameter and the second preset parameter, the determining unit 503 is specifically for acquiring a first grayscale of the first frame image, wherein grayscale includes resolution of the current frame in the height and width directions and three primary light (R/G/B); acquiring a second grayscale of the second frame image; performing a difference operation between the second grayscale and the first grayscale to obtain a difference value; acquiring R/G/B of each pixel in the first frame image; determining a maximum value among R/G/B of each pixel being a grayscale eigenvalue of a corresponding pixel; for each partition in the first frame image, using a maximum value among all the grayscale eigenvalues in the partition as a backlight coefficient reference value of the partition, and the acquired backlight coefficient reference value is a first reference backlight coefficient; determining the first reference backlight coefficient of each partition of the first frame image according to the grayscale eigenvalue of each pixel; acquiring a second backlight coefficient of each partition in the second frame image; calculating a root mean square difference value between the first reference backlight coefficients and second backlight coefficients to all partitions; determining the grayscale compensation coefficient of the second frame image is the grayscale compensation coefficient of the first frame image if the root mean square difference value is less than a first preset threshold and the root mean square difference value less than or equal to a second default threshold.

In a possible example, in the aspect of determining the first reference backlight coefficient of each partition of the first frame image according to the grayscale eigenvalue of each pixel, the determining unit 503 is specifically for: control determining a plurality of pixels included in each partition of the first frame image; and control determining a maximum grayscale eigenvalue among a plurality of grayscale eigenvalue corresponding to the plurality of pixels is the first reference backlight coefficient of the corresponding partition.

In a possible example, in the aspect of determining a backlight coefficient of each partition of the first frame image, the determining unit 503 is specifically for control performing a difference operation between a first backlight coefficient reference value of each partition of the first frame image and a second backlight coefficient of each partition of the second frame image to obtain a difference value; and control if the difference value is greater than a third preset threshold is detected, adding or subtracting a first preset adjustment value from the second backlight coefficient to obtain a first backlight coefficient of each partition; or control if the difference value is less than or equal to the third preset threshold, adding or subtracting a second preset adjustment value from the second backlight coefficient to obtain a first backlight coefficient of each partition; and control the first preset adjustment value being greater than the second preset adjustment value.

In a possible example, in the aspect of driving the backlight according to the determined backlight coefficient of each partition and driving the display screen according to the grayscale compensation coefficient to display the first frame image, the displaying unit 504 is specifically for: control inputting a first backlight coefficient into a backlight driver chip to instruct the backlight driver chip to drive the backlight; and control inputting a grayscale compensation coefficient into an image driver chip to instruct the image driver chip to display the first frame image.

The embodiment of the present application further provides a computer storage medium, where the computer storage medium stores a computer program for electronic data exchange, and the computer program causes the computer to execute part or all of the steps of any one of the methods in the foregoing method embodiments; and the computer includes a display driving device.

The embodiments of the present application provide a computer program product, comprising a non-transitory computer-readable storage medium storing a computer program operable to cause a computer to execute part or all of the steps of any one of the methods in the foregoing method embodiments. The computer program product may be a software installation package, which includes a display driver.

It should be noted that, for the foregoing method embodiments, for simplicity of description, all of them are described as a series of combinations of actions. However, those skilled in the art should understand that the present application is not limited to the described sequence of actions, and certain steps may be performed in other sequences or concurrently as according to the application. Secondly, those skilled in the art should also know that the embodiments described in the specification belong to the preferred embodiments, and the actions and modules involved are not necessarily required in the present application.

In the foregoing embodiments, the description of each embodiment has its own emphasis. For the parts that are not described in detail in one embodiment, reference may be made to related descriptions in other embodiments.

In the several embodiments provided in the present application, it should be understood that the disclosed apparatus may be implemented in other manners. For example, the device embodiments described above are merely exemplary. For example, the unit division is merely logical function division and may be other division in actual implementation. For example, a plurality of units or components may be combined or may be Integrate into another system, or some features may be ignored or not executed. In addition, the shown or discussed mutual coupling or direct coupling or communication connection may be indirect coupling or communication connection through some interfaces, devices or units, and may be electrical or other forms.

The units described as separate components may or may not be physically separated. The components displayed as units may or may not be physical units, that is, may be located in one place or may also be distributed to multiple network units. Some or all of the units may be selected according to actual needs to achieve the objectives of the solution in this embodiment.

In addition, each of the functional units in the embodiments of the present application may be integrated in one processing unit, or each of the units may exist alone physically, or two or more units may be integrated in one unit. The above-mentioned integrated unit can be implemented in the form of hardware or in the form of software functional unit.

The integrated unit, if implemented in the form of a software functional unit and sold or used as an independent product, may be stored in a computer-readable memory. Based on this understanding, the technical solutions of the present application essentially, or the part contributing to the prior art, or all or part of the technical solutions may be implemented in the form of a software product stored in a memory, Includes several instructions for enabling one computer device (which may be a personal computer, a server or a network device) to perform all or part of the steps of the method according to the embodiments of the present application. The foregoing memory includes various media capable of storing program codes, such as a USB flash disk, a read-only memory (ROM), a random access memory (RAM), a removable hard disk, a magnetic disk, or an optical disk.

Persons of ordinary skill in the art should understand that all or part of the steps in the methods in the foregoing embodiments may be implemented by a program instructing relevant hardware. The program may be stored in a computer-readable memory, and the memory may include a flash drive, Read-only memory (English: Read-Only Memory, ROM for short), random access memory (English: Random Access Memory, RAM for short), a magnetic disk or an optical disk.

The embodiments of the present application are described in detail above. Specific examples are used herein to describe the principles and implementation manners of the present application. The description of the foregoing embodiments is merely used to help understand the method and core concept of the present application. Meanwhile, those skilled in the art can make changes to the specific implementation manners and the application scope according to the ideas of the present application. In view of the foregoing, the contents of the specification should not be construed as limiting the present application.

What is claimed is:

1. An image display method, applied in a display device, comprising:

determining a first preset parameter of each partition of a backlight relative to a first frame image when a display request for the first frame image is detected, the preset parameter comprising grayscale and/or backlight brightness;

acquiring a second preset parameter of each partition of the backlight relative to a second frame image, the second frame image being a previous frame image of the first frame image;

determining a grayscale compensation coefficient of a first frame image according to the first preset parameter and the second preset parameter;

determining a backlight coefficient of each partition of the first frame image; and driving the backlight according to the determined backlight coefficient of each partition and driving a display screen according to the grayscale compensation coefficient to display the first frame image.

2. The method according to claim 1, wherein the preset parameter includes a grayscale coefficient, and the "determining a grayscale compensation coefficient of the first frame image according to the first preset parameter and the second preset parameter" includes:

acquiring a first grayscale of the first frame image, wherein grayscale includes resolution of the current frame in the height and width directions and three primary light(R/G/B);

acquiring a second grayscale of the second frame image;

performing a difference operation between the second grayscale and the first grayscale to obtain a difference value; and determining the grayscale compensation coefficient of the second frame image is the grayscale compensation coefficient of the first frame image when the difference value is detected to be less than a first default threshold.

3. The method according to claim 2, wherein "driving the backlight according to the determined backlight coefficient of each partition and driving a display screen according to the grayscale compensation coefficient to display the first frame image" includes:

inputting a first backlight coefficient into a backlight driver chip to instruct the backlight driver chip to drive the backlight; and inputting a grayscale compensation coefficient into an image driver chip to instruct the image driver chip to display the first frame image drive the backlight.

4. The method according to claim 1, wherein the "driving the backlight according to the determined backlight coefficient of each partition and driving a display screen according to the grayscale compensation coefficient to display the first frame image" includes:

Inputting a first backlight coefficient into a backlight driver chip to instruct the backlight driver chip to drive the backlight; and inputting a grayscale compensation coefficient into an image driver chip to instruct the image driver chip to display the first frame image drive the backlight.

5. The method according to claim 1, wherein the "determining a backlight coefficient of each partition of the first frame image" includes:

performing a difference operation between a first backlight coefficient reference value of each partition of the first frame image and a second backlight coefficient of each partition of the second frame image to obtain a difference value;

if the difference value is greater than a third preset threshold is detected, adding or subtracting a first preset adjustment value from the second backlight coefficient to obtain a first backlight coefficient of each partition; or if the difference value is less than or equal to the third preset threshold, adding or subtracting a second preset adjustment value from the second backlight coefficient to obtain a first backlight coefficient of each partition; and the first preset adjustment value being greater than the second preset adjustment value.

6. The method according to claim 5, wherein "driving the backlight according to the determined backlight coefficient of each partition and driving a display screen according to the grayscale compensation coefficient to display the first frame image" includes:

inputting a first backlight coefficient into a backlight driver chip to instruct the backlight driver chip to drive the backlight; and inputting a grayscale compensation coefficient into an image driver chip to instruct the image driver chip to display the first frame image drive the backlight.

7. The method according to claim 1, wherein the preset parameter includes a grayscale coefficient, and the "determining a grayscale compensation coefficient of the first frame image according to the first preset parameter and the second preset parameter" includes:

acquiring R/G/B of each pixel in the first frame image;

determining a maximum value among R/G/B of each pixel being a grayscale eigenvalue of a corresponding pixel;

for each partition in the first frame image, using a maximum value among all the grayscale eigenvalues in the partition as a backlight coefficient reference value of the partition, and the acquired backlight coefficient reference value is a first reference backlight coefficient;

determining the first reference backlight coefficient of each partition of the first frame image according to the grayscale eigenvalue of each pixel;

acquiring a second backlight coefficient of each partition in the second frame image;

calculating a root mean square difference value between the first reference backlight coefficients and second backlight coefficients to all partitions; and determining the grayscale compensation coefficient of the second frame image is the grayscale compensation coefficient of the first frame image if the root mean square difference value is less than or equal to the second preset threshold.

8. The method according to claim 7, wherein the "determining a backlight coefficient of each partition of the first frame image" includes:

performing a difference operation between a first backlight coefficient reference value of each partition of the first frame image and a second backlight coefficient of each partition of the second frame image to obtain a difference value;

if the difference value is greater than a third preset threshold is detected, adding or subtracting a first preset adjustment value from the second backlight coefficient to obtain a first backlight coefficient of each partition; or if the difference value is less than or equal to the third preset threshold, adding or subtracting a second preset adjustment value from the second backlight coefficient to obtain a first backlight coefficient of each partition; and the first preset adjustment value being greater than the second preset adjustment value.

9. The method according to claim 7, wherein "driving the backlight according to the determined backlight coefficient of each partition and driving a display screen according to the grayscale compensation coefficient to display the first frame image" includes:

inputting a first backlight coefficient into a backlight driver chip to instruct the backlight driver chip to drive the backlight; and inputting a grayscale compensation coefficient into an image driver chip to instruct the image driver chip to display the first frame image drive the backlight.

10. The method according to claim 7, wherein "determining the first reference backlight coefficient of each partition of the first frame image according to the grayscale eigenvalue of each pixel" includes:

determining a plurality of pixels included in each partition of the first frame image; and determining a maximum grayscale eigen value among a plurality of grayscale eigenvalue corresponding to the plurality of pixels is the first reference backlight coefficient of the corresponding partition.

11. The method according to claim 10, wherein "driving the backlight according to the determined backlight coefficient of each partition and driving a display screen according to the grayscale compensation coefficient to display the first frame image" includes:

inputting a first backlight coefficient into a backlight driver chip to instruct the backlight driver chip to drive the backlight; and inputting a grayscale compensation coefficient into an image driver chip to instruct the image driver chip to display the first frame image drive the backlight.

12. The method according to claim 10, wherein the "determining a backlight coefficient of each partition of the first frame image" includes:

performing a difference operation between a first backlight coefficient reference value of each partition of the first frame image and a second backlight coefficient of each partition of the second frame image to obtain a difference value;

if the difference value is greater than a third preset threshold is detected, adding or subtracting a first preset adjustment value from the second backlight coefficient to obtain a first backlight coefficient of each partition; or if the difference value is less than or equal to the third preset threshold, adding or subtracting a second preset adjustment value from the second backlight coefficient to obtain a first backlight coefficient of each partition; and the first preset adjustment value being greater than the second preset adjustment value.

13. The method according to claim 1, wherein the preset parameter includes a grayscale coefficient and a backlight coefficient, and the "determining a grayscale compensation coefficient of the first frame image according to the first preset parameter and the second preset parameter" includes:

acquiring a first grayscale of the first frame image, wherein grayscale includes resolution of the current frame in the height and width directions and three primary light (R/G/B);

acquiring a second grayscale of the second frame image;

performing a difference operation between the second grayscale and the first grayscale to obtain a difference value;

acquiring R/G/B of each pixel in the first frame image;

determining a maximum value among R/G/B of each pixel being a grayscale eigenvalue of a corresponding pixel;

for each partition in the first frame image, using a maximum value among all the grayscale eigenvalues in the partition as a backlight coefficient reference value of the partition, and the acquired backlight coefficient reference value is a first reference backlight coefficient;

determining the first reference backlight coefficient of each partition of the first frame image according to the grayscale eigenvalue of each pixel;

acquiring a second backlight coefficient of each partition in the second frame image;

calculating a root mean square difference value between the first reference backlight coefficients and second backlight coefficients to all partitions; and determining the grayscale compensation coefficient of the second frame image is the grayscale compensation coefficient of the first frame image if the root mean square difference value is less than a first preset threshold and the root mean square difference value less than or equal to a second default threshold.

14. The method according to claim 13, wherein the "determining a backlight coefficient of each partition of the first frame image" includes:

performing a difference operation between a first backlight coefficient reference value of each partition of the first frame image and a second backlight coefficient of each partition of the second frame image to obtain a difference value;

if the difference value is greater than a third preset threshold is detected, adding or subtracting a first preset adjustment value from the second backlight coefficient to obtain a first backlight coefficient of each partition; or if the difference value is less than or equal to the third preset threshold, adding or subtracting a second preset adjustment value from the second backlight coefficient to obtain a first backlight coefficient of each partition; and the first preset adjustment value being greater than the second preset adjustment value.

15. The method according to claim 13, wherein "driving the backlight according to the determined backlight coefficient of each partition and driving a display screen according to the grayscale compensation coefficient to display the first frame image" includes:

inputting a first backlight coefficient into a backlight driver chip to instruct the backlight driver chip to drive the backlight; and inputting a grayscale compensation coefficient into an image driver chip to instruct the image driver chip to display the first frame image drive the backlight.

16. The method according to claim 13, wherein "determining the first reference backlight coefficient of each partition of the first frame image according to the grayscale eigenvalue of each pixel" includes:

determining a plurality of pixels included in each partition of the first frame image; and for each partition in the first frame image, using a maximum value among all the grayscale eigenvalues in the partition as a backlight coefficient reference value of the partition, and the acquired backlight coefficient reference value is a first reference backlight coefficient.

17. The method according to claim 16, wherein "driving the backlight according to the determined backlight coefficient of each partition and driving a display screen according to the grayscale compensation coefficient to display the first frame image" includes:

inputting a first backlight coefficient into a backlight driver chip to instruct the backlight driver chip to drive the backlight; and inputting a grayscale compensation coefficient into an image driver chip to instruct the image driver chip to display the first frame image drive the backlight.

18. The method according to claim 16, wherein the "determining a backlight coefficient of each partition of the first frame image" includes:

performing a difference operation between a first backlight coefficient reference value of each partition of the first frame image and a second backlight coefficient of each partition of the second frame image to obtain a difference value;

if the difference value is greater than a third preset threshold is detected, adding or subtracting a first preset adjustment value from the second backlight coefficient to obtain a first backlight coefficient of each partition; or if the difference value is less than or equal to the third preset threshold, adding or subtracting a second preset adjustment value from the second backlight coefficient to obtain a first backlight coefficient of each partition; and the first preset adjustment value being greater than the second preset adjustment value.

19. An image display device, comprising: a processor, a memory, and one or more programs, the one or more procedure is stored in the storage, and the program including: an instruction for executing the steps of the method as in claim 1.

* * * * *